United States Patent [19]

Sato et al.

[11] 4,103,873

[45] Aug. 1, 1978

[54] OVERLOAD PROTECTION APPARATUS FOR HOISTING MACHINE

[75] Inventors: Isao Sato; Shigenori Gomi; Mitsuyuki Furuichi, all of Hitachi, Japan

[73] Assignee: Hitachi, Ltd., Japan

[21] Appl. No.: 778,934

[22] Filed: Mar. 18, 1977

[30] Foreign Application Priority Data

Apr. 2, 1976 [JP] Japan ..... 51-36955

[51] Int. Cl.[2] ..... B66D 1/00

[52] U.S. Cl. ..... 254/168; 188/181 T; 254/187.3

[58] Field of Search ..... 192/150; 188/181 T; 254/168, 167, 173 R, 174, 187.1, 187.3, 187.4, 187.8

[56] References Cited

U.S. PATENT DOCUMENTS

| | | | |
|---|---|---|---|
| 1,883,164 | 10/1932 | Jassakos | 192/150 |
| 2,901,076 | 8/1959 | Dean | 192/150 |
| 3,194,371 | 7/1965 | Rabinow | 192/150 X |
| 3,285,573 | 11/1966 | Hanawa et al. | 254/168 |
| 3,305,058 | 2/1967 | Orwin et al. | 192/150 X |
| 3,754,413 | 8/1973 | Borrini | 64/30 R |

*Primary Examiner*—Drayton E. Hoffman
*Assistant Examiner*—Donald W. Underwood
*Attorney, Agent, or Firm*—Craig & Antonelli

[57] ABSTRACT

The disclosure relates to an overload protection apparatus for hoisting machines such as rope hoists or chain blocks. One gear incorporated in the reduction gear train of the hoisting machine is composed of an outer and an inner gear units between which torque is transmitted through resilient means acting therebetween. The resilient means are adapted to be compressed, upon receipt of an excessively large torque, i.e. in case of an overload, to allow a relative movement in the direction of rotation between the outer and the inner gear units. The relative movements of the gear units in the direction of rotation is then converted into a movement in the direction of thrust. Detecting switch is provided for opening an electric circuit for lifting, upon detecting the movement in the direction of thrust, thereby to stop the lifting operation.

6 Claims, 13 Drawing Figures

OVERLOAD PROTECTION APPARATUS FOR HOISTING MACHINE

BACKGROUND OF THE INVENTION

The present invention relates to hoisting machines such as rope hoists or chain blocks and, more particularly, to such hoisting machines provided with an overload protection apparatus.

Conventional overload protection apparatus, for example such one as used in a chain block merely for the purpose of avoiding an overload operation at the time of commencement of hoisting, consists of a slip gear which is incorporated in a reduction gear train and adapted to perform a power transmission by means of friction.

Namely, in the overload protection device of this type, any one gear in a reduction gear train on a sprocket shaft is split into two halves between which interposed is a lining. The torque transmission is performed, through the lining, as one of the halves is resiliently pressed on to the other by a resilient member such as a disc spring or the like, the pressing force being adjustable by means of, for example, a screw.

This overload protection apparatus has, however, a fundamental drawback that the load once lifted up may accidentally be lowered, due to an unexpected application of an external force caused by vibration, swinging or the like, when the load torque is large and is scarcely withstood by the resistance torque provided by the slip gear.

Thus, when a hoisting machine incorporating this conventional overload protecting device is used as a lift, the load once lifted up and now suspended may dangerously fall down when an excessive load torque is applied to the hoist.

At the same time, when the height of the lifted load is adjusted by so-called inching operation which consists in winding and unwinding the rope repeatedly, an impact force may be generated to break the balance of the torque resulting in an accidental lowering of the load.

In any way, this conventional technique relies upon an unstable frictional force, and this conventional apparatus may act against the will to incur a danger, although it is inherently designed as a safety device.

OBJECT AND SUMMARY OF THE INVENTION

It is therefore an object of the invention to provide an overload protection apparatus for hoisting machine capable of functioning safely without fail.

It is another object of the invention to provide an overload protection apparatus for hoisting machine in which wearing down of each frictional part is reduced by applying an initial tension to a resilient body.

It is still another object of the invention to provide an overload protection apparatus for hoisting machine, in which means are provided for preventing a pulsation thereby to provide an improved precision control of the load.

It is a further object of the invention to provide an overload protection apparatus for hoisting machine, wherein a torque-adjusting work can be dispensed with.

According to the invention, any one gear incorporated in the reduction gear train of a hoisting machine is composed of an outer gear unit and an inner gear unit. The torque transmission between the outer and the inner gear units is performed by a resilient member which sustains a certain load torque. When an excessively large torque is applied, the resilient body is compressed to cause a change in relative positions of the units in the direction of rotation.

Means are provided interlocking with the gear for converting this change in relative positions in the direction of rotation into a movement in a direction of thrust. The thrust resulted by an overload is conveniently detected by a switch which in turn acts to open an electric circuit for hoisting.

These and other objects, as well as advantageous features of the invention will become clear from the following description of preferred embodiments taken in conjunction with the attached drawings in which:

DESCRIPTION OF PREFERRED EMBODIMENTS

Figure 1:
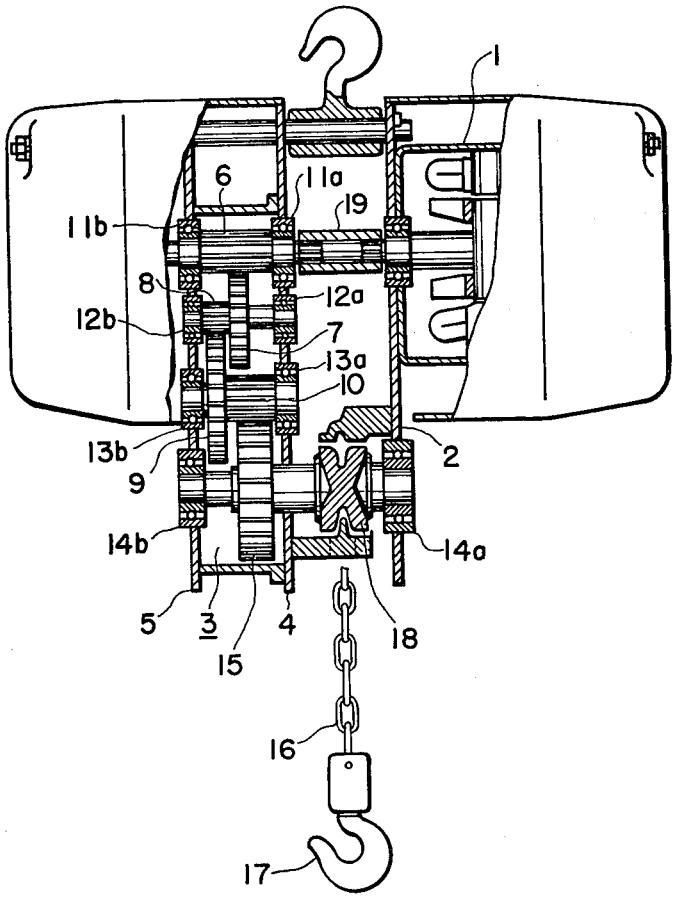
FIG. 1 is an illustration showing the whole structure of a chain block to which the overload protection apparatus of the invention is adapted to be applied, in which a reduction gear assembly is specifically exploded.

Referring at first to FIG. 1 showing a chain block to which an overload protection apparatus of the present invention is suitably applied, the chain block houses an electric motor 1 for hoisting fixedly secured to a main frame 2. A speed reduction section 3 is provided for transmitting a driving torque from the electric motor 1.

The reduction section 3 incorporates a first pinion 6, a first gear 7, a second pinion 8, a second gear 9, a third pinion 10, a third gear 15 and a sprockets 18 which are supported by main frames 4, 5. The reduction section 3 further has parallelly disposed input and output shafts.

The first pinion 6, the second pinion 8, the third pinion 10 and the sprocket shafts 18 are supported by bearings 11*a*, 11*b*; 12*a*, 12*b*; 13*a*, 13*b*; and 14*a*; 14*b*, respectively which are provided on the frames 4 and 5. The third gear 15 is connected to the sprocket shaft 18 around which a load-hoisting chain 16 goes for raising and lowering a lower hook 17.

The electric motor 1 and the first pinion 6 are coupled to each other by a coupling 19, so that a torque may be transmitted through the reduction section 3, when the motor 1 is energized, for lifting and lowering the load.

Figure 2:
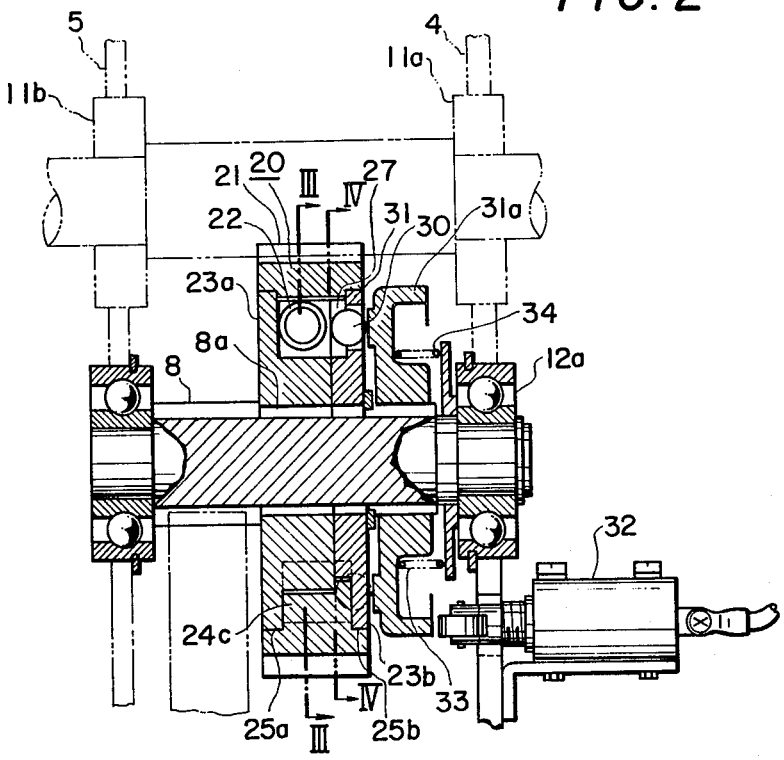
FIG. 2 is a sectional view of an essential part of an embodiment of the present invention.

Referring to FIG. 2 showing an overload protection apparatus of the invention applied to the first stage of the reduction section of above explained electric chain block, there is an additional provision of an overload detective unit. Although the overload protection apparatus of the invention is shown to be applied to the first stage, it is not exclusive and the apparatus can be applied to any stage of the reduction section. However, the size of the apparatus is unfavourably enlarged when it is installed in the stage of a lower speed, due to the increase of the torque transmitted. This is why the installation of the apparatus in the first stage is preferred.

An improved construction of the first gear for cooperation with the second pinion will be explained with specific reference to FIGS,. 2 to 6 inclusive.

A peripheral gear 20 which constitutes an outer gear unit has at its outer periphery a conventional gear part 21 for torque transmission.

Within the peripheral gear 20, disposed are gear supports 23*a* and 23*b* confronting each other. These gear supports 23*a* and 23*b* in combination constitute an inner gear unit.

The gear support 23*a* houses a protruding member 24*b*, there is provided a spline 8*a* for meshing with the second pinion 8.

The peripheral gear 20 is provided at its internal surface with three projections 24*c*.

Three compression springs 22 are disposed between the projections 24*a* of the gear support 23*a* and the projections 24*c*. Namely, along the inner periphery of the peripheral gear 20, provided are three projections 24*c* for engaging the compression springs 22 and the projections 24*a* on the gear support 23. Fitting parts 25*a*, 25*b* in the form of annular recesses or steps are provided at respective axial ends of the peripheral gear 20.

The peripheral gear 20 itself is supported, through gear supports 23*a*, 23*b*, by the second pinion 8.

The spline 8*a* formed on the inner periphery of the gear support 23*a* is adapted for engaging the second pinion 8 to be retained thereby.

Figure 3:
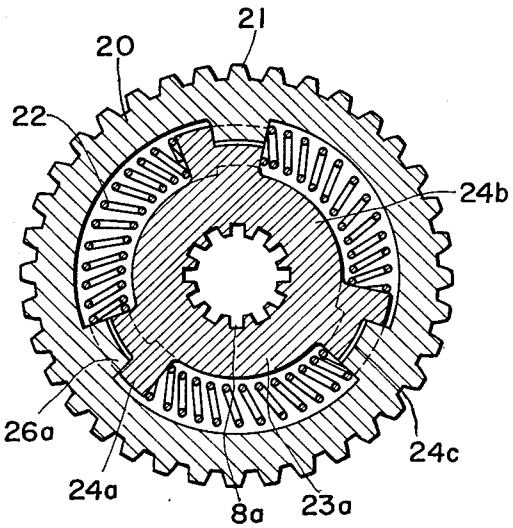
FIG. 3 is a sectional view taken along the line III—III of FIG. 2.
Figure 6A:
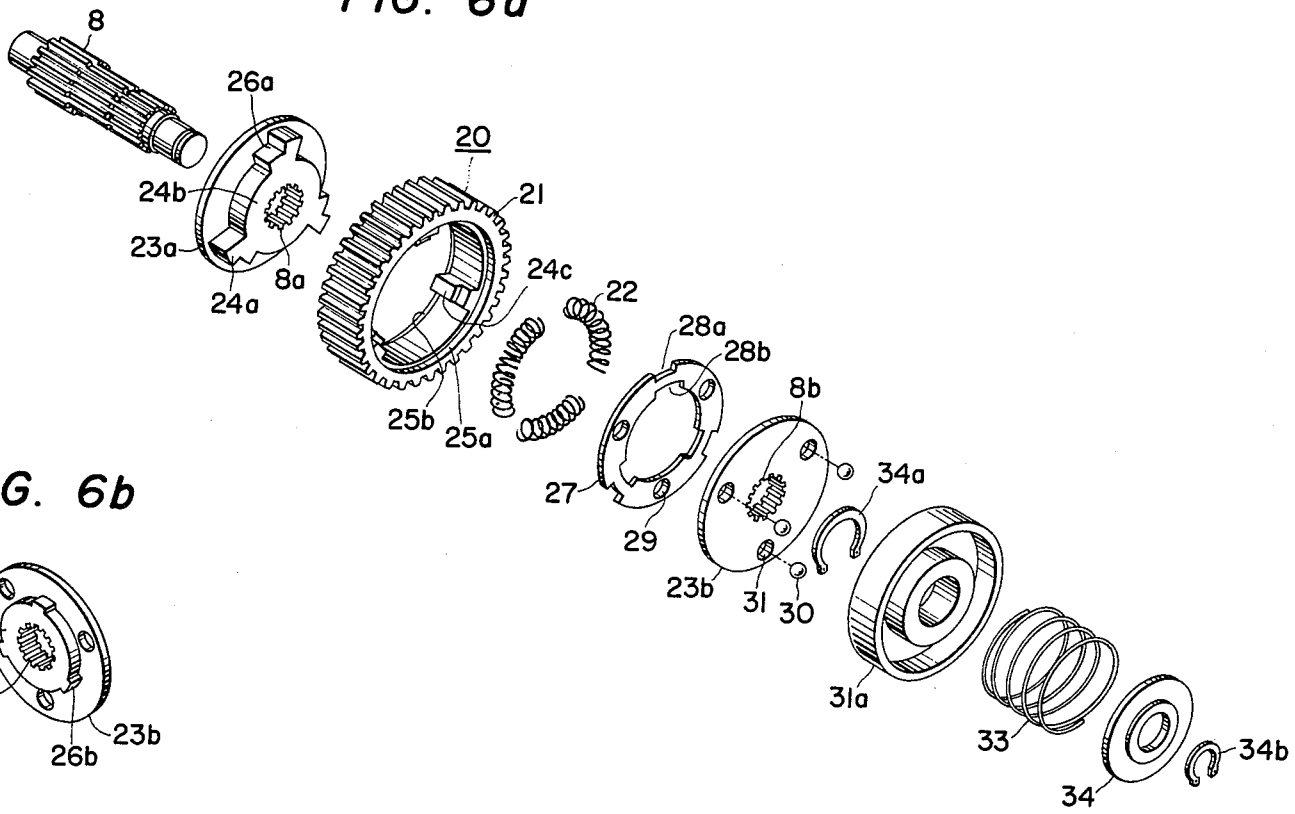
Figure 6B:
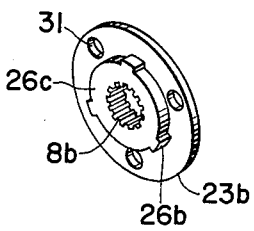
Figure 9:
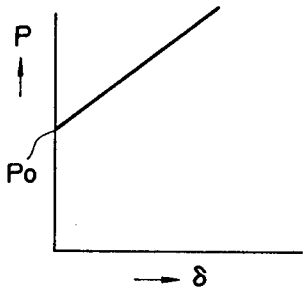
FIG. 9 is a graphrical representation of a relationship between strain and tension in the resilient member in the structure shown in FIG. 7.
Figure 10:
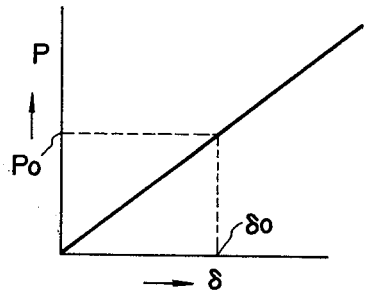
FIG. 10 is a graphical representation of a relationship between strain and tension in the resilient member of the structure shown in FIG. 8.

On the projection 24*b* at the side of the gear support 23*a* confronting the other gear support 23*b*, provided are three retaining portions 26*a* which oppose to the projections 24*c* of the peripheral gear 20, as will be seen from FIGS. 3 and 6.

The retaining portions 26*a* abuts at their sides against the compression springs 22. Thus, the peripheral gear 20, gear support 23*a* and the other gear support 23*b* are resiliently held by each other, through a constant load provided by the compression springs 22.

Therefore, the positional relationships between these members varies in accordance with the torque imparted by the load to be lifted, which is transmitted through the second pinion 8. Thus, when the torque appearing between the gear supports 23*a* and 23*b* exceeds the resistance torque provided by the compression springs 22, a relative rotation of the gear supports takes place, compressing the springs 22 by the retaining portions 26*a*.

However, when the torque transmitted is smaller than that exerted by the springs 22, the gear supports rotate unitarily, with the projections 24*c* of the peripheral gear 20 engaging the retaining portions 26*a* of the gear support 23.

The gear support 23*b* has a configuration similar to that of the gear support 23*a*, and is held on the second pinion 8, confronting the gear support 23*a*.

A cavity defined by the peripheral gear 20 and the gear supports 23*a*, 23*b* houses a ball supporting plates 27, as well as the compression spring 22.

This ball supporting plate 27 is provided for converting the change in relative position in the direction of rotation into an amount of a thrust.

Figure 5:
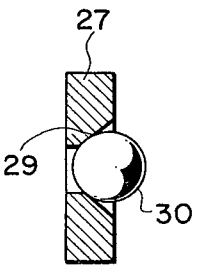
FIG. 5 is a sectional view of essential part of a guide member of a steel ball, FIG. 6 (a) is a perspective exploded view of the overload protection apparatus in accordance with the invention, FIG. 6 (b) is a perspective view of a gear support 23*b*.
Figure 4:
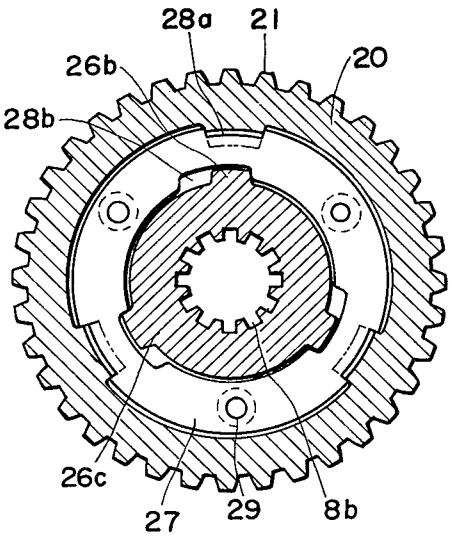
FIG. 4 is a sectional view taken along the line IV—IV of FIG. 2.

As will be seen from FIGS. 4,5 and 6, the ball supporting plate 27 has on its outer periphery three recesses 28*a* for engaging and retaining the projections 24*c* of the peripheral gear 20, while recesses 28*b* are formed in the inner peripheral surface of the supporting plate 27 at portions corresponding to the recesses 28*a* in the outer periphery. The recesses 28*b* at the inner periphery is adapted to retain the retaining portion 26*b* of the gear support 23*b* allowing the rotation of the later over a certain angular range. The ball supporting plate 27 further has in its surface confronting the gear support 23*b* three ball retaining openings 29 which have conical sections as shown in FIG. 5.

The gear support 23*b* is provided in its inner peripheral wall with a spline 8*b* for engagement with the second pinion 8, and at its one side confronting the gear support 23*a* with a protrusion 26*c* on which the aforementioned three retaining portions 26*b* are unitarily formed. The gear support 23*b* further has three openings 31 which constitute guide bores for the balls, at its portions corresponding to the ball retaining openings 29 on the ball supporting plate 27. Three spherical steel balls 31 are adapted to be received and retained by the ball guide openings 31 and the ball retaining openings 29. The diameter of the ball retaining opening 29 at its end closer to the gear support 23*a* is smaller than that of the balls 30, while the ball guide opening 31 has a diameter larger than that of the steel ball 30.

Therefore, when a relative displacement takes place between the peripheral gear 20 and the gear supports 23*a*, 23*b*, due to an application of an excessive load torque, the ball supporting plate 27 acts unitarily with the peripheral gear 20.

The steel balls 30 biased into the ball retaining openings 29 are revolved unitarily with the gear support 23*b*, due to the engagement of the ball openings 31 with the balls 30. Thus, the balls 30 rolls over the inclined conical surface of the ball retaining openings 29 and are moved rightwardly as viewed in FIG. 2.

A striker 31*a* adapted to engage steel balls 30 is provided at one side of the gear support 23*b*, for receiving the thrust caused by the movement of the balls in the direction of the thrust.

The striker 31*a* is provided for free rotation and sliding with respect to the second pinion, being guided by the outer periphery of the second pinion 8.

Downwardly from the bearing 12*a* carried by the main frame 4, also carried by the main frame 4 is a detecting switch 32 adapted to open and close an electric circuit upon detecting thrust pressure caused by the movement of the balls 30.

A compression spring 33 accomodated within a cylindrical cavity of the striker 31*a* has one end retained by a spring retainer 34, and is adapted to exert a biasing force on the striker 31*a* and steel balls 30. The striker 31*a* has sealing members 34*a* and 34*b*.

Hereinafter, the principle upon which the present invention relies will be explained on the basis of a simplified structure.

Figure 7:
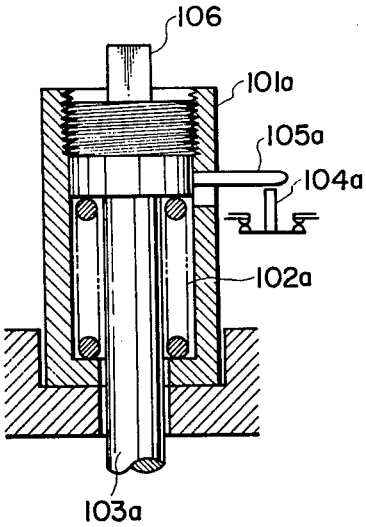
FIG. 7 is a sectional view of an essential part of an apparatus embodying the inventiobn, and is intended for explaining the principle on which the present invention relies.

Referring to FIG. 7, a cylinder 101*a* houses a resilient member 102*a* for carrying a load, a supporting rod 103*a* connected to the load and other associated members. The supporting rod 103*a* has an arm 105*a* projecting therefrom for operating a switch 104*a*. An adjusting screw 106 is provided for imparting a predetermined initial load to the resilient member 102*a*.

In this arrangement, when the load (not shown) suspended from the supporting rod 103*a* exceed a pressure P*o* provided by the resilient body 102*a*, the arm 105*a* comes to depress the switch 104*a* to open the later, thereby to detect an overload to stop the hoisting. For a load smaller than the pressure P*o*, the support provided by the resilient member can be regarded as a rigid support, i.e. no shrinkage of the resilient member 102*a* takes place.

Figure 8:
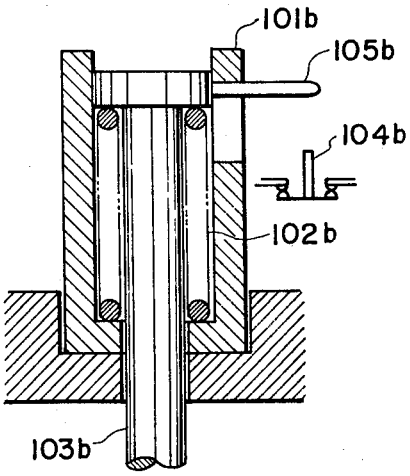
FIG. 8 is a sectional view of an essential part for explaining a principle upon which conventional technique relies.

Referring to FIG. 8 showing a principle of conventional apparatus, no initial tension is given to the resilient member 102*b*. Therefore, the switch 104*b* is operated when the load applied to the resilient member 102*b* comes up to P*o*, i.e. when a strain $\delta_0$ is caused in the resilient member 102*b*. The resilient member 102*b* is compressed to shrink even for a load smaller than P*o*. This conventional arrangement also has a cylinder 101*b*, supporting rod 103*b* and an arm 105*b*.

It will be understood from the foregoing description that, in the arrangement of the present invention, no compression, i.e. the shrinkage and expansion, of the resilient member takes place against a load smaller than the detective load P*o*, thereby to greatly reduce the wearing down of the frictional parts as compared with conventional arrangement, due to the application of the initial load.

In addition, since the expansion and shrinkage of the resilient member takes place only when an overload is applied, a substantial advantage is taken against the fatigue strength, as a result of which the size of the resilient members and other associated members can be diminished.

It is submitted here that, according to the conventional arrangement of FIG. 8, the load comes to have an inertia, by the time when a strain $\delta_o$ of the resilient member is attained, since the switch is operated only after the strain is established.

Figure 11:
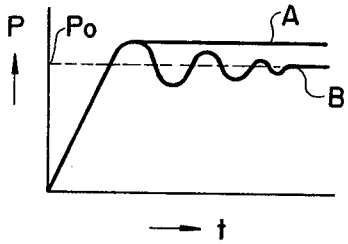
FIG. 11 is a graphical representation for comparing characteristics of the apparatus of the invention and prior arts.

Referring to FIG. 11 which shows pulsating movements of the resilient members, for the purpose of a comparison, in accordance with the present invention and the prior art, the characteristics of the resilient members of the invention and that of the prior art are given by curves A and B, respectively.

It will be seen that the load on the resilient member at first goes beyond the point for operating the switch and oscillates or fluctuates for a while until the strain $\delta_o$ is obtained, in the conventional arrangement, while, according to the invention, no oscillation or pulsation is caused, since there is no need for time *t* for obtaining the strain $\delta_o$, thereby to provide a substantially improved accuracy of the operation against the load.

Figure 12:
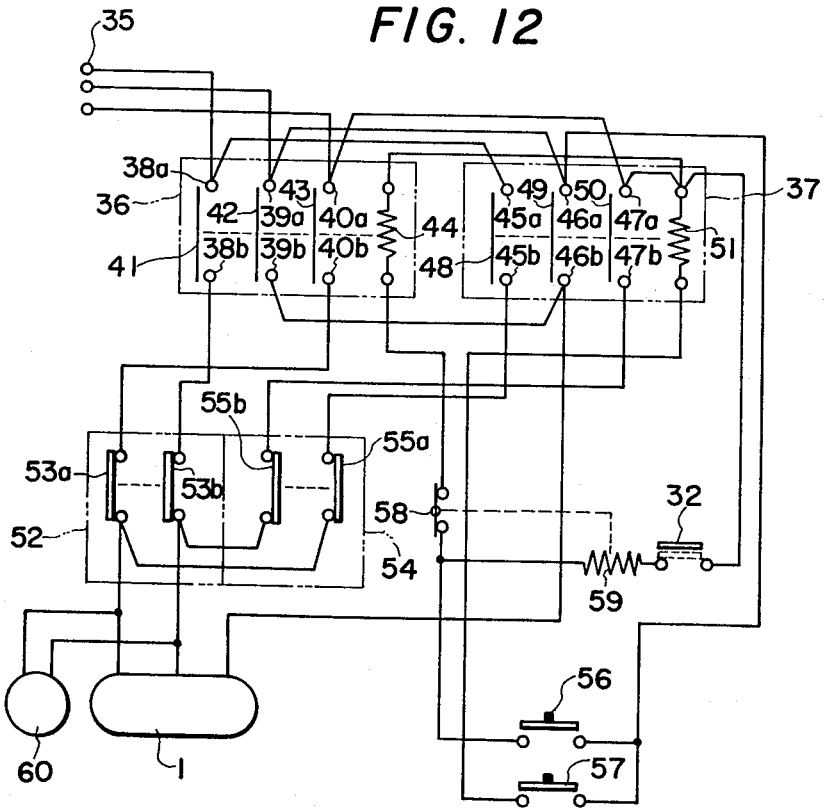
FIG. 12 is a diagram of an electric circuit for the chain block in accordance with the present invention.

FIG. 12 shows an example of the electric circuit for the electric chain block in accordance with the present invention.

An electromagnet switch 36 for lifting and an electromagnet switch 37 for lowering are adapted to be energized by a thre-phase electric power supplied by a power source 35. The lifting electromagnet switch 36 has an exciter coil 44, as well as contacts 38*a*–38*b*, 39*a*–39*b*, 40*a*–40*b*, and contact pieces 41,42,43, while the lowering electromagnet switch 37 has a similar construction.

A lifting limit switch 52 is adapted to mechanically open a contact 53*a*–55*b*, when a lower hook 17 is lifted up to its uppermost position, while a lowering limit switch 54 is adapted to open a contact 55*a*–55*b*, when the hook 17 is lowered to its lowermost position, thereby to stop the hoist.

Switches 56 and 57 are provided for lifting and lowering, respectively, which are in the form of push button switch. The lifting push button switch 56 is connected at its one end to the secondary side of the exciter coil 44 for lifting, through a contact (this is "*b*" contact) 58 of a thermal timer 59.

The thermal timer 59 is connected in series to the detecting switch 32, with its one end connected to a point between the "*b*" contact 58 and the detecting switch 32, while the other end being connected to the primary side of the exciter coil 44.

The thermal timer 59 incorporates a heater which, when heated upon being supplied with electric power, acts to open a bimetal contact 58 in a several seconds after the energization of the heater.

The bimetal switch contact 58 is adapted to be naturally cooled, after the power supply to the heater is stopped, to return to its normal position in several to several tens of seconds.

These arrangement are for performing a function of delaying means for delaying the operation of the circuit behind the time of operation of the detecting switch 32, or for holding the detecting swtich 32 upon detecting the operation of the detecting switch 32.

In operation, the source line 35 is connected to a predetermined source. A depression of the push button switch 56 or 57 causes an energization of the exciter coil 44 or 51 of the electromagnet siwtch 36 or 37. Then, contacts 38*a*–38*b*, 39*a*–39*b*, 40*a*–40*b*, or contacts 45*a*–45*b*, 46*a*–46*b*, 47*a*–47*b* are closed to energize the hoisting electric motor 1. Simultaneously with the energization of the motor 1, a braking mechanism 60 is opened so as to allow the torque from the motor 1 to be transmitted to the sprocket 18, through the coupling 19, and the reduction gear train 6,7,8,9,10 and 15, so as to raise or lower the lower hook 17 connected through a link chain 16 going around the sprocket 18, for lifting or lowering the load.

Supposing here that the load now actually applied is small and does not cause a torque which exceeds the resistance torque exerted by the compression springs 22 between the peripheral gear 20 and the gear supports 23*a*,23*b*, no change takes place of the relative positions of the halves of the split gear, so that the gear acts as a conventional solid gear having no overload protecting means.

Therefore, no movement of the balls 30 and the striker 31 in the thrusting direction takes place to allow the electric circuit to perform its usual function.

However, supposing here that the load applied is large to cause a torque exceeding the rated torque, the load torque causes the compression springs 22 to be compressed, through a counterclockwise rotation of the gear supports 23*a*,23*b* as viewed in FIG. 3.

Consequently, the gear supports 23*a*,23*b* splined to the second pinion 8 are forced to rotate in the counterclockwise direction, by the load torque. The ball guiding openings 31 formed in the gear support 23*b* are accordingly revolved.

To the contrary, the ball supporting plate 27 which is made unitary with the peripheral gear 20 through the retaining portions 27 is kept stationary, so that the relative position of the ball guiding openings 31 is changed with respect to the ball retaining opening openings 29, resulting in circumferential shifting of the steel balls 31 from the ball retaining holes 29.

It will be seen that this shifting of the balls 30 in the rightward direction as viewed in FIG. 2 and FIG. 5 causes the balls 30 to climb the conical surface of the openings 29 up to the flattened portion on the ball supporting plate 27.

Consequently, the striker 31*a* is moved rightwardly, compressing the spring 33, thereby to actuate the detecting switch 32 for closing it to open the circuit. Namely, as the detecting switch 32 is closed, a circuit is completed through 40-47-32-59-46 and then 39, so as to energize the timer (heater) 59. After several seconds has elapsed, the "b" contact 58 is close to stop the power supply to the exciter coil 44 of the lifting electromagnet switch 36, thereby to stop the motor 1.

Since the detecting switch 32 is put to affect only the circuit for lifting, the lowering circuit can perform its normal function, even during the acting of the detecting switch 32.

The timer switch 58,59 is incorporated for the purpose of protecting the circuit from wearing due to the chattering. Namely, when a critical load, i.e. the load corresponding to that scarecely born by the compression springs 22, is applied, an unfavourable oscillation takes place to cause the chattering of the detecting switch 32, and consequent chattering of the electromagnet switches 36,37, to shorten the lives of them.

However, thanks to the provision of the aforementioned delaying function performed by the timer switch 58,59, the opening of the electromagnet switches is conveniently delayed, until the oscillation of the load is damped and settled.

The delaying timer may be constituted by other means than the thermal switch having a bimetal contact.

It is of course to possible to design the circuit for direct opening of the lifting circuit by the detecting switch 32. However, a certain oscillation is inevitable, during a period of several seconds after the load has left the ground, which causes the aforementioned chattering of the circuit. The provision of the delaying timer is therefore preferable.

As aforementioned, the detacting switch affects only the lifting circuit and does never hinder the operation of the circuit for lowering the load. Thus, when an overload is detected, the load can be lowered, as required, without fail.

It will be clear from the foregoing description that the overload protection apparatus of the invention, which does not relies upon frictional slip gear, renders the hoisting machine highly safe, sure and inexpensive.

More specifically, according to the invention, the magnitude of the torque at which the overload protection apparatus functions is directly defined by the force of the compression springs, which ensures a highly improved accuracy of the operation of the overload protection apparatus without the troublesome work of torque adjustment.

At the same time, the lowering of the load once lifted can be performed without fail, even when the overload detecting switch is functioning.

It is also to be noted that the hoisting machine acts for lowering the load, and not for lifting, when the compression spring is accidentally broken.

What is claimed is:

1. In an overload protection apparatus for hoisting machines having a driving section including an electric motor, an output, and a reduction section interconnecting said driving section and said output, with said reduction section having parallelly disposed input and output shafts, the improvement comprising:

a gear drivingly mounted and connected between said input and output shafts, said gear including an outer gear unit having peripheral gear for engagement with a pinion and an inner gear unit constituted by first and second gear support means facing to each other and housed by said outer gear unit, said first and second gear supporting means have respective projecting members, said first and second gear supporting means abutting each other at their projecting members to provide a power transmission path to raise the load, spring means disposed between said first and second gear support means and in contact with said outer gear unit, said spring means being adapted to allow a relative movement of said inner and outer gear units when the load torque actually applied exceeds a predetermined torque in the direction of rotation applied to raise the load, means for converting the relative movement in the direction of rotation into a movement in the direction of thrust, and means for detecting the movement caused by said converting means and wherein said means for detecting the movement of said converting means effects a stopping of the lifting operation upon the movement of said converting means in the direction of thrust.

2. An improvement as claimed in claim 1, wherein said spring means are constituted by compression springs.

3. An improvement as claimed in claim 1, wherein said projecting member of said first gear supporting means has projections and the inner peripheral surface of said outer gear unit has projections, said spring means being disposed to act between said projections on said first gear support means and said projections formed on the inner peripheral surface of said outer gear unit.

4. An improvement as claimed in claim 3, wherein said means for converting the relative movement in the direction of rotation into a movement in the direction of thrust includes an interacting member which is mounted between the first and the second gear support means on said projecting member of said second gear support unit.

5. An improvement as claimed in claim 4, wherein said means for converting the relative movement in the direction of rotation into a movement in the direction of thrust further includes spherical balls which are retained between corresponding openings formed in said second gear support means and said interacting member, said improvement further including a provision of a striker member adapted to resiliently press said second gear support means, said strike member being further adapted to allow the movement of said balls through said openings of said second gear support means, said balls are retained between said interacting member and said striker member.

6. An improvement as claimed in claim 5, wherein said striker member is pressed against said second gear support means by means of a spring.

* * * * *